US006260713B1

(12) United States Patent
Brown

(10) Patent No.: US 6,260,713 B1
(45) Date of Patent: Jul. 17, 2001

(54) CHERRY SIZING PROCESS AND APPARATUS

(75) Inventor: Robert A. Brown, Wenatchee, WA (US)

(73) Assignee: Stemilt Growers, Inc., Wenatchee, WA (US)

( * ) Notice: Subject to any disclaimer, the term of this patent is extended or adjusted under 35 U.S.C. 154(b) by 0 days.

(21) Appl. No.: 09/481,417

(22) Filed: Jan. 12, 2000

(51) Int. Cl.[7] ..... B07C 5/12

(52) U.S. Cl. ..... 209/670; 209/509; 209/552; 209/606; 209/621; 209/655; 209/659; 209/660; 209/667; 209/668

(58) Field of Search ..... 209/509, 552, 209/606, 621, 655, 659, 660, 667, 668, 670

(56) References Cited

U.S. PATENT DOCUMENTS

| | | |
|---|---|---|
| 785,748 | 3/1905 | Maull . |
| 838,402 | 12/1906 | Gunckel . |
| 891,225 | 6/1908 | Anderson . |
| 916,647 | 3/1909 | Anderson . |
| 1,025,587 | 5/1912 | Norman . |
| 1,042,037 | 10/1912 | Rofkab . |
| 1,148,165 | 7/1915 | Hardie . |
| 1,647,816 | 11/1927 | Riddell . |
| 1,661,501 | 3/1928 | Riddell . |
| 1,811,991 | 6/1931 | Bates . |
| 1,832,035 | 11/1931 | Leib . |
| 2,343,042 | 2/1944 | Barry . |
| 2,370,539 | 2/1945 | Hodecker . |
| 2,699,253 | 1/1955 | Miller . |
| 3,220,548 | 11/1965 | Flodin . |
| 3,627,126 | 12/1971 | Fitzgerald . |
| 3,770,123 | 11/1973 | Mraz . |
| 3,874,508 | 4/1975 | Cronan . |
| 4,172,527 | 10/1979 | Bost . |
| 4,364,479 | 12/1982 | Sardo . |
| 4,763,794 | 8/1988 | Billington, III . |
| 5,360,119 | 11/1994 | Nakamura . |
| 5,373,947 | 12/1994 | Nakamura . |
| 5,411,152 | 5/1995 | Matthews . |
| 5,413,226 | 5/1995 | Matthews . |
| 5,810,175 | 9/1998 | Williamson . |

FOREIGN PATENT DOCUMENTS

| | | |
|---|---|---|
| 3116699 | 11/1982 | (DE) . |
| 256095 | 12/1927 | (IT) . |
| 17548 | 12/1901 | (SE) . |

*Primary Examiner*—Donald P. Walsh
*Assistant Examiner*—Mark J. Beauchaine
(74) *Attorney, Agent, or Firm*—Oblon, Spivak, McClelland, Maier & Neustadt, P.C.

(57) ABSTRACT

A cherry sizing process and apparatus in which cherries are sized in stages, with each stage including substantially parallel rollers and with each stage having a gap different than the other stages. Preferably, the larger size cherries are removed before the final sizing stage. In addition, the larger cherries are preferably removed as an overs product, i.e., as the cherries which do not pass through the gap between rollers at the stage at which the larger cherries are removed. The different gap settings can be set based upon recommended ranges which have been determined based upon the recognition that a particular gap will have a predictable removal efficiency for each of various cherry sizes. In addition, the gap can be selected utilizing a simulator which determines the result of each sizing stage based upon statistical information concerning the size distribution of cherries to be sized and the removal efficiencies of each stage for each cherry size. Based upon the results predicted by the simulator, the gap or other sizing conditions (such as the speed of the roller) can be refined.

31 Claims, 9 Drawing Sheets

CHERRY SIZING PROCESS AND APPARATUS

FIELD OF THE INVENTION

The invention relates to a method and apparatus for sorting items having various sizes. The invention particularly provides a method and apparatus for sorting produce items according to size, and the method and apparatus are particularly advantageous for sizing cherries.

DISCUSSION OF BACKGROUND

The sizes of produce items such as cherries naturally vary. In addition, the quantities of different sizes can vary depending upon a number of factors such as the site location, the horticultural practices of the grower, and the weather. For example, more larger cherries will typically be produced where the weather for the growing season has been particularly desirable as compared with a growing season having poor weather. In addition, a grower with more desirable horticultural practices, such as proper pruning and fertilizing, will generally produce larger cherries as compared with a grower that does not follow such practices.

Typically, after cherries are harvested they must be sorted into different sizes, since large cherries are much more desirable and command a greater price. In fact, the largest size cherries can command prices up to ten times that of the smallest size cherries. Accordingly, it is extremely important to effectively sort produce items such as cherries according to size. Growers with strict horticultural practices find effective sizing particularly important since a substantial investment is associated with such horticultural practices in order to produce larger cherries. If the cherries are not properly sorted so that larger cherries are sorted into a smaller size grade, this investment is lost. Of course, it is not practically possible to size/measure and sort each and every cherry due to the volume and the extremely large number of individual articles (cherries) that must be handled. Produce items such as cherries are typically sized as they feed over rotating rollers having a diverging gap spacing therebetween, so that smaller cherries are generally removed from the flow stream at smaller portions of the gap and larger cherries are generally removed from the flow stream at larger portions of the gap. This type of sizing/sorting process is an approximation, and each resulting size grouping will have a number of cherries which are larger or smaller than the nominal size range (or grade) for that grouping. However, in sorting cherries, it is important to minimize the amount of smaller cherries which might be grouped with the larger size cherries, since an excessive number of smaller cherries will lead to customer complaints and potential violations of agricultural regulations. For example, in the State of Washington, known for its cherry production, cherries sold as having a specified size must have no greater than 10% of those cherries below the specified size. Many growers/packers also have self-imposed quality standards which exceed agricultural regulations.

It is also important to minimize the number of larger cherries which are grouped with smaller cherries, since the larger cherries can be sold at a greater price. Thus, if larger cherries are sorted into a smaller size grade, a monetary loss is incurred. Accordingly, it is important to sort cherries by size so that a group of cherries of a particular size grade does not contain an excessive amount of cherries above that size or an excessive amount of cherries below that size.

One difficulty in sorting cherries by size is that the diverging roller sorting apparatus removes cherries based upon their minimum dimension. However, from an agricultural product standpoint, cherries are sized by their maximum dimension. In particular, FIG. 1 shows a sizing card 10 which is utilized to determine the particular size of a cherry. If the maximum diameter of the cherry is larger than the diameter of the hole of the card, the cherry will not pass through the hole in the card and attains that size grade. It is of course impractical to size each cherry of a substantial volume of cherries utilizing such a hand held card. Such hand held cards are thus only suitable for a quality control check of selected to samples of cherries or to size a portion of a large volume to gain statistical information concerning that volume.

As is apparent from FIG. 1, certain of the apertures in the sizing card have a numerical designation, e.g., "9 row" or "10 row." These designations originated from very early sizing designations in which cherries were packed in a box of a predetermined size. Cherries of a size in which 9 would fit in a row of the box were thus considered "9 row" cherries, while slightly smaller cherries of a size in which 10 would fit in a row of the box were "10 row" cherries. Thus, a 9 row cherry is larger than a 10 row cherry. Similarly, an 11 row cherry is smaller than a 10 row cherry. The 9 row, 10 row, etc. designations are still widely utilized today, as are intermediate sizes such as 9½ row, 10½ row, etc. As shown in FIG. 1, the apertures have designated sizes corresponding to the standard 8, 8½, 9, 9½, 10, 10½, 11, 11½ and 12 row sizes. As shown in the sizing card, the 8 row cherries have a maximum diameter which is at least 84/64" (33.33 mm), the 8½ row cherries have a maximum diameter which is at least 79/64" (31.35 mm), the 9 row cherries have a maximum diameter which is at least 75/65" (29.76 mm), 9.5 row cherries have a maximum diameter of at least 71/64" (28.17 mm), 10 row cherries have a maximum diameter of at least 67/64" (26.59 mm), 10.5 row have a maximum diameter of at least 1" (25.4 mm), 11 row have a maximum diameter of at least 61/64" (24.20 mm), 11.5 row have a maximum diameter of at 57/64" (22.62 mm), and 12 row have a maximum diameter of at least 54/64" (21.43 mm). Although not designated on the sizing card of FIG. 1, the cherries having a maximum diameter of at least 52/64" (20.63 mm) are 13 row cherries.

It should be noted that when cherries are sized and packed, each and every one of the possible size grades are not typically utilized. For example, if the crop is good and the amount of very large cherries is high, the largest size of the cherries packed will be 9 row or better cherries (i.e., the cherries are large enough to receive at least a 9 row grade). However, if the amount of 9 row or better cherries is small so as to not be worthwhile packing separately, the largest size cherry will be 9.5 row or better, and the 9.5 row or better product will include not only the 9.5 row cherries, but also cherries large enough to receive a 9 row grade. Thus, a "9.5 or better" product includes cherries which are 9.5 row and larger. Similarly, the second largest product grade of cherries which could be sorted from a crop could be a "10 row or better" product, or a "10.5 row or better" product. The number of size grades into which a given crop are sorted can also vary depending upon customer demand. For example, depending upon customer demand, it might only be necessary to divide cherries into three size groups. In addition, the very large sizes (8 row and 8.5 row) are typically only present in sufficient quantities to pack for certain cherry varieties such as Lapin. Thus, it is to be understood that although a large number of different size grades are known in the industry, as would be understood by those skilled in the art, the cherries of a given crop or group are typically not divided into each and every size grade.

As mentioned earlier, large quantities of cherries have typically been sorted utilizing a diverging roller arrangement as shown in FIG. 2. With this arrangement, a pair of rotating rollers 20, 22 are mounted so that the gap between the rollers is smaller at the upstream end as compared with the downstream end. The rollers are inclined downwardly and rotate so that the cherries are conveyed along the rollers and in the gap between the rollers. As the cherries are conveyed along the rollers, they fall through the gap between the rollers if a dimension of a cherry is smaller than the gap spacing and if that cherry dimension is oriented with respect to the gap to allow the cherry to fall through the gap. Since the rollers diverge, the smaller cherries will generally fall through the gap between the rollers closer to the upstream end of the rollers, while the larger cherries will generally be conveyed further and will fall between the rollers at a location where the gap is larger.

The diverging roller arrangement presents a number of difficulties. First, the diverging rollers do not size cherries according to their maximum dimension (which is the dimension which determines the actual cherry size grade in the industry), but rather according to their minimum dimension. In particular, as the cherries are conveyed along the rollers, they can fall through the gap as long as the dimension of the cherry which is aligned with the gap is small enough. Thus, if the minimum dimension of the cherry "sees" the gap between the rollers, the cherry can fall through the gap and be grouped with a smaller size grade, even though the largest dimension of that cherry will warrant a larger size grading. Thus, the prior art diverging roller arrangement can be wasteful in that larger size cherries can be lost to the smaller grades, since the smaller dimensions of the larger size cherries allows the larger cherries to fall through the gap between the diverging rollers prematurely. The diverging roller arrangement is particularly problematic in that the larger cherries are removed last since the diverging roller arrangement provides the largest gap dimension at the downstream end of the rollers. Accordingly, the larger size cherries are conveyed the greatest distance and have a greater opportunity for their smallest dimension to find the gap between the rollers and fall into a smaller size grade. The loss of larger cherries to smaller size grades is particularly problematic to growers that invest substantial amounts of money in horticultural practices that produce larger cherries.

To reduce the amount of larger cherries which are lost to the smaller size grades, the gap between the diverging rollers can be decreased. However, the amount by which the gap can be decreased is limited, since a decrease in the gap size increases the amount of smaller cherries which will be sorted into lager size grades. As discussed earlier, while the smaller cherries generally fall through the gap sooner (i.e., closer to the upstream end of the diverging rollers) than the larger cherries, a portion of the smaller cherries is conveyed past their actual size so that they fall into a size grading which is larger than their actual size. The smaller cherries can be conveyed to a larger size grade for a number of reasons. In particular, the gap size for a given location at which cherries will be removed for a particular size grade will be smaller than the diameter of the sizing card which corresponds to that grade (i.e., the maximum cherry diameter), to account for the fact that the cherries can fall through the diverging gap when the minimum dimension "sees" the gap. In addition, the cherries typically have stems and can bounce slightly as they are conveyed, which can further allow the cherries to be conveyed downstream past their actual size grade. If the gap between the rollers is narrowed to decrease the amount of larger cherries which are lost to the smaller size grade, a larger number of smaller cherries will travel downstream to larger size grades so that an unacceptably large amount of smaller cherries are present in the larger size grades.

Data concerning minimum cherry dimension vs. maximum dimension (true size) has also revealed that there is no uniform pattern between the minimum dimensions and the true sizes of a group of cherries. As a result, a further difficulty in sizing cherries with the conventional diverging roll arrangement is that the diverging roll tends to size cherries by their minimum dimension and there is no uniform correlation between the minimum dimension, the maximum dimension which can be reliably used to sort cherries according to their maximum size by measuring their minimum size. FIGS. 3(*a*)–(*f*) represent the results of an analysis of some 20,000 individual cherries, with the cherries grouped according to their true size (based upon their maximum diameter), and with the graphs for each size group showing the distribution of minimum size dimensions. In particular, FIGS. 3(*a*)–(*e*) respectively show the minimum diameter size distribution for each of the 9 row, 10 row, 11 row, 12 row and 13 row true sizes. FIG. 3(*f*) includes the superposed distributions of FIGS. 3(*a*)–(*e*). As is apparent, not only do the cherries of a given maximum dimension (i.e., true size) have a wide range of minimum dimensions, there is also a significant overlap of the minimum dimensions for different maximum dimensions. Particularly notable are the extremely large overlaps of the 9 row with the 10 row and the 10 row with the 11 row. Accordingly, a cherry having a given minimum dimension (the dimension which allows the cherry to go through the smallest gap of a diverging roller sorter) could have a number of different true sizes. The difficulties presented by the overlapping minimum dimensions for different maximum dimensions are noticed in sizing cherries using the conventional diverging roller arrangement. In particular, 10 row cherries are often found in 11 row and 12 row size grades. Similarly, 9 row cherries are often lost to the 10 row and 11 row grades. In view of the foregoing, it is difficult to sort cherries according to their true size utilizing a diverging roller arrangement which tends to size cherries based upon their minimum dimension.

A further shortcoming with the prior art arrangement is that adjustment of the gap (by moving the rollers closer to or farther from one another) results in an adjustment of the gap along the entire length of the rollers. In addition, the conventional diverging roller arrangement simply divides a typical roll length (commonly an 84" roller) into equal segments for each size into which the cherries are being sorted. Thus, if cherries are being sorted into five different sizes, an 84" roller is evenly divided so that approximately 17–18" segments are provided for each size grade. This approach severely constrains the ability to match the gaps of the particular segments to the gap most desirable for a particular size grade, and erroneously assumes that the gap should uniformly increase with each successive size grade. Moreover, since the gaps are all determined by the diverging relationship of the same pair of rollers, adjusting the gap to provide better performance at one region of the rollers can result in a deterioration of the performance at another region of the rollers. For example, if the gap spacing is widened to decrease the amount of smaller cherries which are found in the larger size grades, the gap is widened along the entire length of the rollers and an excessive number of larger cherries can be lost to the smaller size grades. Similarly, if the gap spacing is decreased to decrease the amount of larger cherries which are lost to the smaller size grades, an excessive number of smaller cherries can be conveyed to the larger size grades, resulting in an unacceptable amount of smaller cherries in the larger size gradings.

A still further shortcoming of the prior art is that the gap has been adjusted on a trial and error basis. In particular, if a sorting operation has begun and it is determined that an excessive number of smaller cherries are present in the larger size grades, the gap is increased so that the smaller cherries will drop out earlier, and the amount of the gap increase is essentially a guess. Particularly since the size distributions vary from one group of cherries to another (e.g., groups from different growers), the response to a given gap adjustment has been unpredictable, and such a gap adjustment might correct one sizing problem but result in another sizing problem.

In view of the shortcomings of prior art sizing apparatus and processes and in view of the importance in maximizing the price which cherries can command while maintaining satisfactory quality control, an improved sizing/sorting method and apparatus is needed which can properly sort cherries by size so that an excessive number of larger cherries are not lost to the smaller size grades while an excessive number of smaller cherries are also not sorted into the larger size grades.

SUMMARY OF THE INVENTION

It is an object of the invention to provide an improved sizing apparatus and method which can better sort items, particularly produce items, and more particularly cherries, so that an excessive number of oversized and undersized cherries are not present in a particular size grade after sorting.

In accordance with the present invention, rather than utilizing a single elongated set of diverging rollers, plural pairs of rollers are provided so that the sizing/sorting is accomplished in stages. With this arrangement, the gaps between the rollers can be individually adjusted and the rollers need not rely upon the diverging relationship of a single set of rollers to accomplish sorting/sizing of various sizes. The rollers are preferably parallel or nearly parallel so that each set of rollers has a substantially constant gap spacing. In accordance with one aspect of the present invention, it has been recognized that a given gap spacing will have a relatively constant efficiency in removing various sizes of cherries, despite the fact that the minimum size dimensions for different true sizes overlap. Extensive testing has further revealed information as to the removal efficiencies for various gap sizes. As a result, the amount of cherries of a particular size grade which will be removed by a set of rollers with a particular gap spacing can be predicted. Accordingly, the gaps of each of the stages can be predetermined so that the cherries removed by each stage contain neither an excessive amount of smaller cherries nor an excessive amount of larger cherries without the typical trial and error process. Optionally, a zone sizing simulation system can be utilized in which the operator inputs the cherry size distribution of an incoming group (i.e., the amount of each size from a statistical sample of the incoming group) in the simulator allows the operator to preselect the initial gap setting for optimal recovery with acceptable sizing quality (i.e., less than the specific maximum tolerable percent of cherries smaller than the prescribed grade). In a present form of the sizing simulation system, the system simulates the results of a given gap setting (i.e., the percentage of each size group that will pass or not pass through the gap) based upon empirical data of the percent of each size grade which will pass or not pass through the gap. Knowing the incoming size distribution, the simulation system then determines the results (i.e., the size distribution of cherries which are retained on the rollers and the size distribution of the cherries which pass through the gap) for a given gap setting. Using extensive empirical data, a zone sizing simulation system has been developed that allows the operator to input the incoming cherry size distribution (9, 9.5, 10, 10.5, 11, 11.5 and smaller than 12 row) and preselect the initial gap setting for optimal recovery with acceptable sizing quality (i.e., less than the specified maximum tolerable percent of cherries smaller than the prescribed grade).

The method and apparatus of the present invention includes a number of additional advantageous aspects as compared with prior art cherry sizing processes and apparatus. For example, in accordance with one aspect of the present invention, it has been recognized that it is preferable to remove the largest cherries before the end of the sizing operation, since the opportunity for the smallest dimension of larger cherries to find their way through the gap (and thus be lost to smaller size gradings) is reduced. In addition, it has been recognized that larger size cherries are better removed as an "overs" product, i.e., by retaining cherries which pass over a pair of rotating rollers without passing through the gap between the rollers. In particular, it has been recognized that the recovery efficiency or recovery factor for larger cherries is greater as a "retained on" or "overs" product (i.e., with the gap sized such that the larger cherries do not pass through the rollers) as compared with the recovery efficiency where the gap is sized to remove larger cherries as a "pass through" product (i.e., in which the gap is sized so that the larger cherries will pass through the gap). Thus, in order to remove larger cherries from a flow of cherries, the gap is sized so that the larger cherries pass over the rotating rollers without passing through the gap, and this "overs" product is then retained as a final or end product of a particular larger size grade. In accordance with the invention, the gap utilized for removing larger size cherries is thus smaller as compared with that utilized in the conventional diverging roller arrangement, since the larger cherries are removed as a retained on or "overs" product rather than, as is the case with the diverging roller arrangement, a pass through product. This tighter gap for the larger size cherries acts as a screen for the smaller cherries, which can thereafter be sorted, while retaining the larger cherries on the rollers with the gap sized so that the larger cherries do not pass through the gap.

In one example of a presently preferred embodiment of the invention, a three stage sorting operation is utilized in which three stages of rotating rollers are provided, with the first having a first gap larger than the second gap provided in the second stage. Similarly, the second gap is larger than a third gap size provided in the third stage. The largest cherries include those which pass over the rotating rollers of the first stage and which do not pass through the gaps between the roller pairs of the first stage. The cherries which pass over the rotating rollers of the first stage are then retained as the largest size product. The cherries which pass through the first gap are then fed to pairs of rotating rollers of the second stage, with each pair having a second gap spacing therebetween which is smaller than the first gap spacing. Cherries which pass over the second pair of rotating rollers and which do not pass through the second gap are retained as a second product, of the second largest size. Cherries which pass through the second gap are fed to the third stage which also include pairs of rotating rollers. A third retained product includes cherries which pass over the pairs of rotating rollers of the third stage and which do not pass through the third gap, while a fourth product includes the cherries which pass through the third gap. Thus, four products can be formed, with the largest including the overs of the first stage of rollers, the second largest including the overs of the second stage of rollers, the third largest including the overs of the third stage of rollers, and the fourth product (the smallest) including the cherries which pass through the gap of the third stage of rollers.

Alternate sizing/sorting arrangements are also disclosed herein. In each of the alternate arrangements, the largest cherries are removed before the last stage or last pair of rotating rollers, and the larger cherries are also retained "overs" products rather than being sized by passing through the gap between a pair of rollers.

The arrangement and process of the invention differs in a number of respects as compared with the prior art diverging roller arrangement. For example, as discussed earlier, with the prior art diverging roller arrangement, the largest cherries are removed last, and the end products are cherries which have been sorted as they pass through the gap of the diverging rollers. This arrangement essentially forces the user to cope with the loss of larger cherries into the smaller size grades in order to avoid excessive amounts of smaller cherries in the larger size grades. In addition, with prior art cherry sorting arrangements, there was no ability to independently vary gap spacings for different size grades, and gap adjustments were made on a trial and error basis. As a result, an adjustment of the gap to provide a more favorable result for one size could provide a disadvantageous result with respect to another size. The arrangement of the invention avoids the constraints of the diverging roller arrangement by utilizing independently adjustable sizing stations and also by avoiding the conventional approach of removing a particular size of cherries according to the location at which the cherries will fall through a diverging gap. Additional differences and advantages of the present invention as compared with the prior art will be apparent from the detailed description provided herein.

BRIEF DESCRIPTION OF THE DRAWINGS

A better appreciation of the present invention and the attended advantages thereof will become apparent from the following detailed description, particularly when considered in conjunction with the drawings in which.

DETAILED DESCRIPTION OF THE PREFERRED EMBODIMENTS

Figure 1:
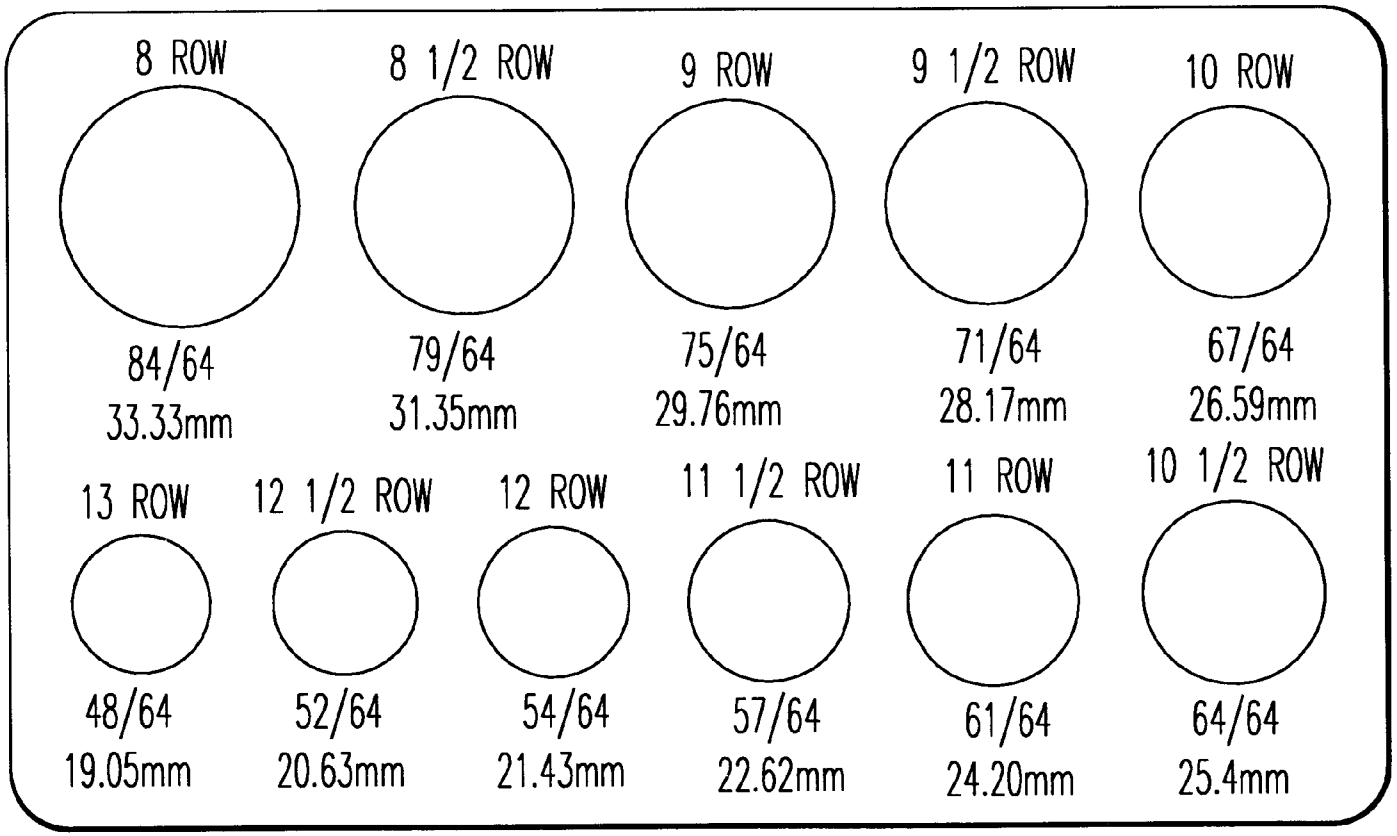
FIG. 1 RELATED ART
FIG. 1 depicts a conventional sizing card which sizes cherries according to their true size or maximum dimension.
Figure 2:
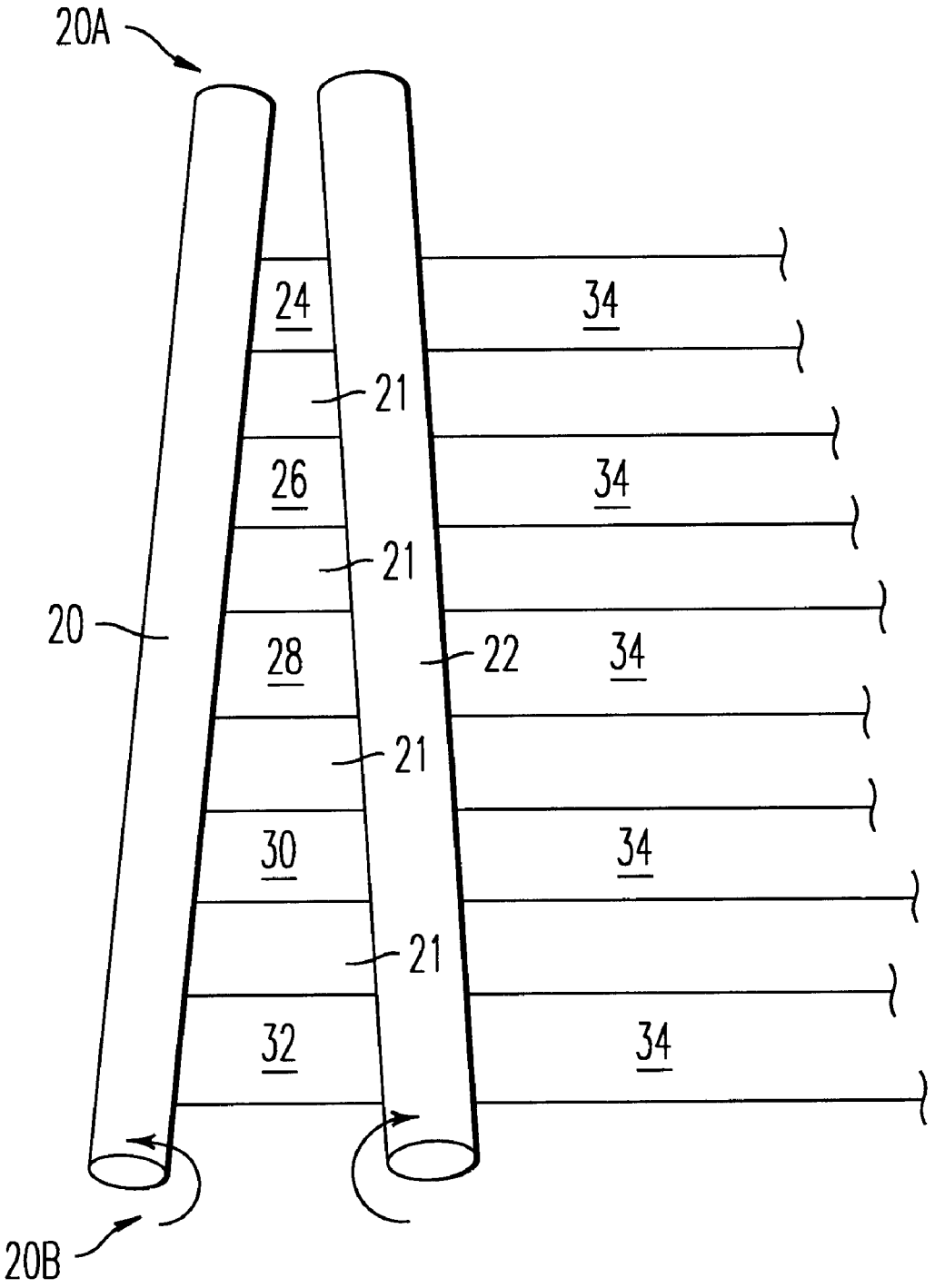
FIG. 2 PRIOR ART
FIG. 2 illustrates a conventional diverging roll arrangement and process.
Figure 3A:
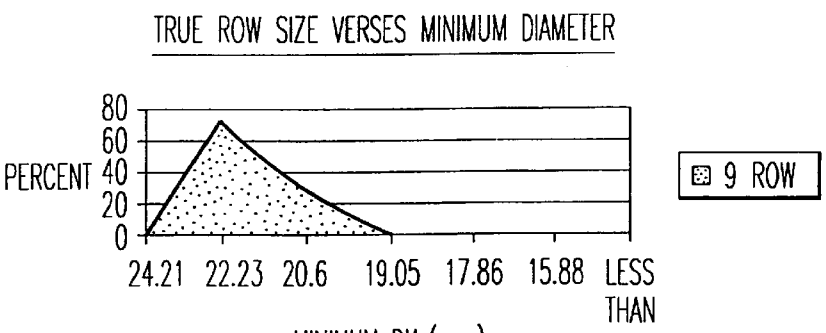
FIGS. 3(*a*)–(*f*) depict minimum diameter size distributions for various true row cherry sizes.
Figure 3B:
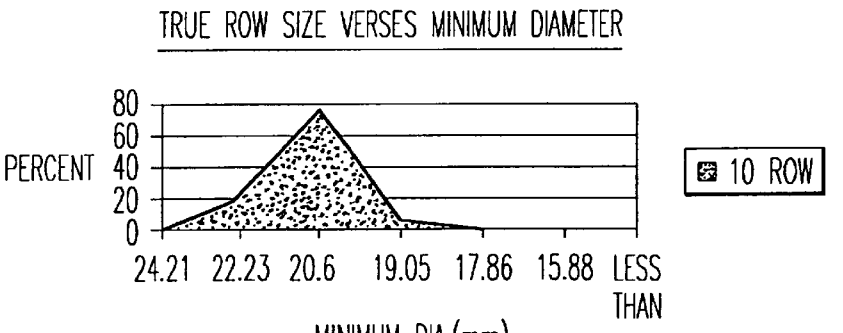
Figure 3C:
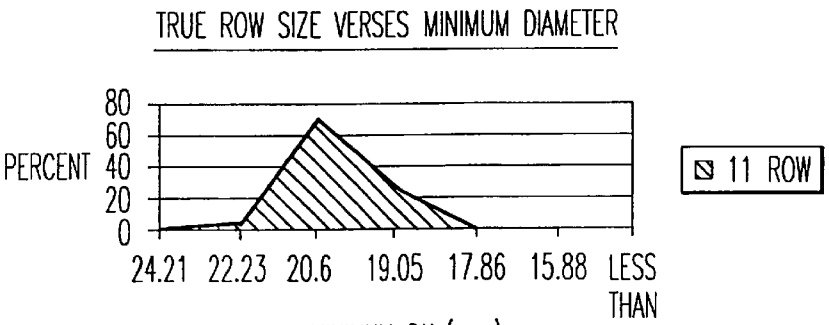
Figure 3D:
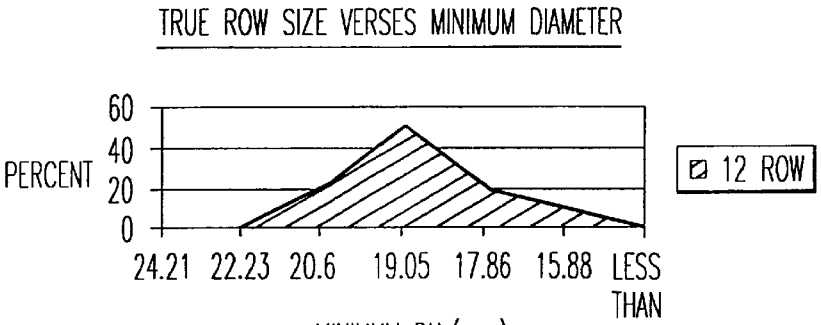
Figure 3E:
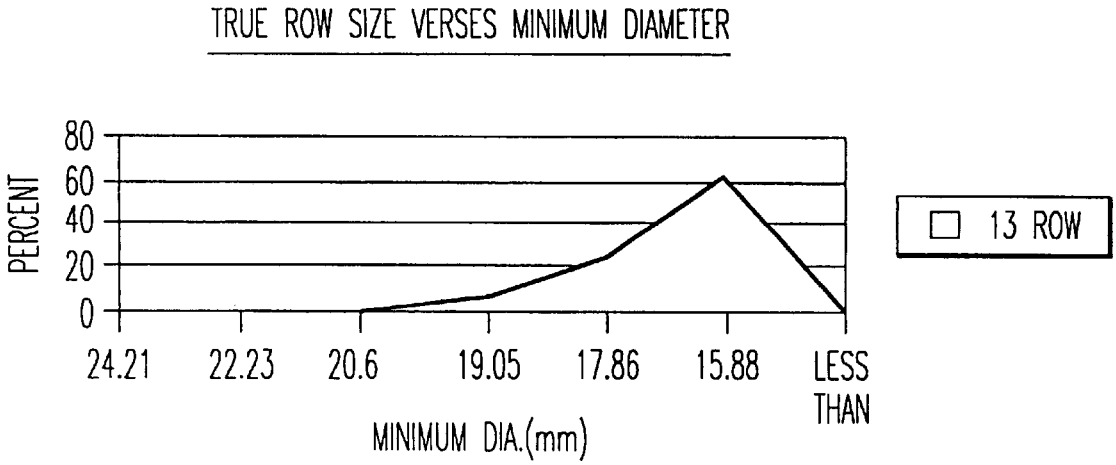
Figure 3F:
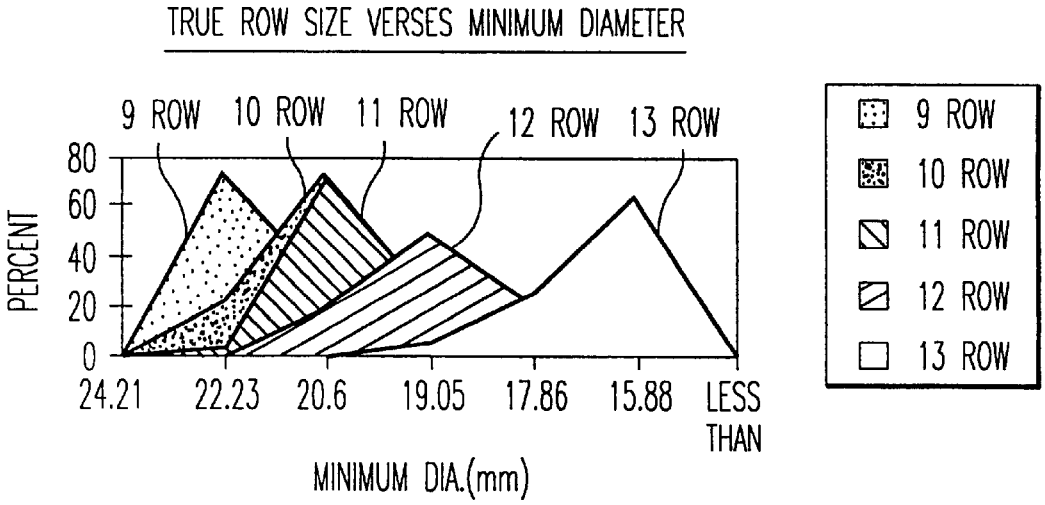

Referring now to the drawings wherein like reference numerals designate like parts through the several views, as discussed earlier, FIG. 2 depicts a prior art diverging roller sizing arrangement. The arrangement includes a pair of diverging rollers 20, 22 in which the gap between the rollers diverges such that the gap spacing at the upstream end 20*a* is smaller than the gap at the downstream end 20*b*. The rollers are inclined and rotate away from one another (as represented by the arrows) such that cherries are conveyed from the upstream end to the downstream end, with cherries falling into various pockets or bins 24, 26, 28, 30, 32 which are separated by spaced landings 21. By virtue of the diverging roller arrangement, smaller cherries will tend to fall into the bins closer to the upstream end 20*a* while larger cherries will tend to fall into bins closer to the downstream end 20*b*. In the conventional arrangement, a conveyer 34 is disposed at the bottom of each bin so that the cherries which fall into the respective bins are carried away (to the right in FIG. 2) to one or more packing stations for packing according to size. The size of the gap at the upstream end of the diverging rollers is in the range of 15 to 19 mm, while the size of the gap at the downstream end is in the range of 22 to 26 mm, and the ratio of the inlet gap to the outlet gap is approximately 0.71. Typically, redundant pairs of such diverging rollers are disposed adjacent to the pair shown in FIG. 2 in order to handle a larger flow of cherries at the same time.

Upstream of the diverging rollers, additional handling operations are performed. In particular, as a flow of cherries initially enters a sizing/packing line, they first pass through a cutter which cuts the stems of the cherries so that when the cherries are sized they are not connected at their stems. The cutter also removes leaves and is often accompanied by a vacuum device which removes leaves and other debris. After the cutting operation, a pre-eliminator diverging roller arrangement is provided. An automatic sampling device continuously samples the cherries prior to the pre-eliminator for statistical size analysis (removing an amount of cherries randomly, with the random samples then sized, e.g., manually for statistical purposes). This information can then be used to preset the sizing stages. The pre-eliminator separates trash and extremely small cherries from the flow of cherries to be sized. In particular, the pre-eliminator diverging rollers have a downstream gap spacing which is smaller than the upstream gap spacing of the diverging rollers used for sizing. The material which falls through the upstream portion of the pre-eliminator diverging rollers includes extremely small, essentially unuseable cherries as well as other unuseable material, such as leaves, twigs, pits, etc. These cherries and other material are typically discarded as trash or landfill material. Cherries which fall through the gap of the pre-eliminator rollers closer to the downstream end are useable, but are not suitable as fresh produce or gourmet cherries. These cherries are often used in processed foods, such as in frozen pies or as cocktail/maraschino cherries. After the pre-eliminator diverging rollers, an inspection/sorting location is provided at which other cherries which are unsuitable for various reasons (damaged, pecked by birds, split skins, etc.) are removed. The cherries are then fed to the diverging roller sizer as discussed above.

Although the prior art arrangement can sort cherries according to size, it suffers from a number of shortcomings as discussed earlier. For example, with the conventional diverging roller arrangement, it is difficult to sort cherries so that the number of smaller cherries which are found in the larger size grades is acceptable while simultaneously preventing an excessive number of larger cherries from being lost into the smaller size grades. Also, as discussed earlier, if gap adjustments are made to vary the cherries which are deposited in a particular size grade, the gap along the entire length of the diverging rollers is adjusted. Thus, an adjustment which might benefit one size grade can be detrimental to another size grade (from a standpoint of having an unacceptably large number of smaller cherries deposited in a larger size grade and/or in having larger cherries lost into a smaller size grade). In addition, the prior art arrangement is particularly disadvantageous in that it tends to sort cherries according to their minimum diameter, while cherries are actually sized (i.e., the industry standard) according to their maximum diameter. Moreover, the prior art arrangement is particularly disadvantageous from a standpoint of losing larger cherries to smaller size grades since the larger cherries are removed last.

Figure 4:
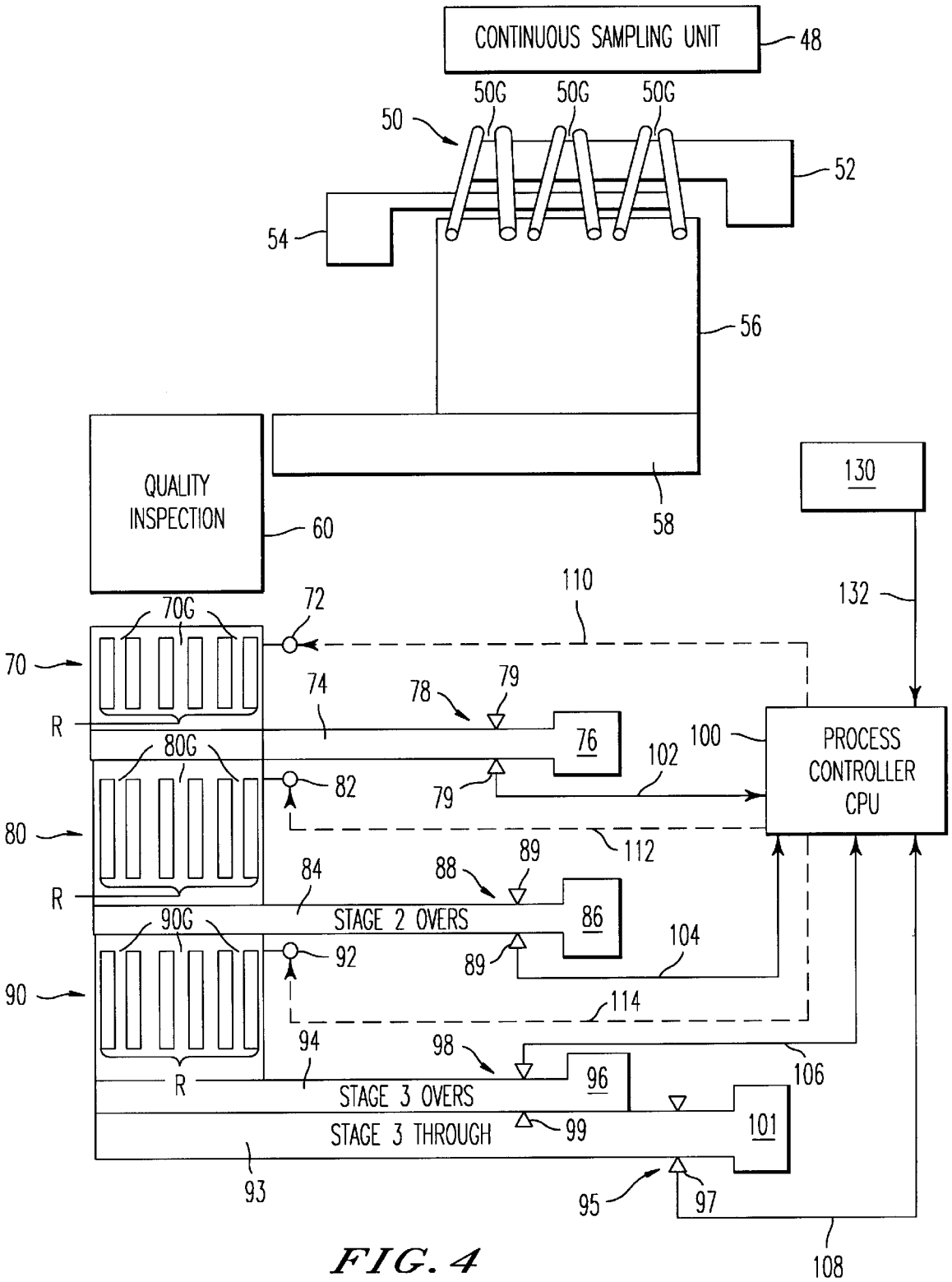
FIG. 4 schematically depicts the overall sizing apparatus and process of the invention.

FIG. 4 schematically depicts an arrangement according to the present invention. As shown in FIG. 4, after the conventional cutting operation, which cuts leaves and stems so that the cherries are separated from one another, the cherries are fed to a series of diverging rollers as is used in the initial stage of a conventional sizing/packing line. These diverging rollers 50 are pre-eliminator rollers, which remove the trash, unuseable cherries and lowest priced cherries, and the remaining cherries are then further conveyed for inspection and sizing. The widest gap of the diverging rollers 50 will typically be smaller than the smallest gap used in any of the sizing stages. As a result, only the smallest cherries will be removed by the pre-eliminator diverging rollers 50. Material which falls through the gaps 50*g* in the first one-third to two-thirds of the length of the diverging rollers 50 is collected as shown at 52 and typically is discarded as trash or landfill. This material includes extremely small cherries, pits, leaves, twigs, etc. Cherries which fall through the gaps 50*g* over the last one-third to two-thirds of the rollers 50 can be collected as shown at 54. These will be cherries which are not suitable for sale as gourmet cherries or fresh produce, but which can be utilized for frozen pies, maraschino cherries, etc. It is to be understood that the divergence of the gap of the rollers 50 is exaggerated in FIG. 4 for illustrative purposes. Typically, the gaps of the pre-eliminator diverging rollers will range from 14–18 mm. Upstream from the pre-eliminator rollers, a sampling device removes cherries from the flow at random intervals so that, e.g, 100 cherries or more per minute are removed. This sampling device is conventionally utilized to provide statistical information concerning the cherries obtained from a grower to determine the price to be paid to a particular grower. In accordance with the present invention, this sampling and statistical information can also be utilized to determine the most advantageous gap setting for the rollers used to size the cherries as will become apparent hereinafter. A conventional continuous sampling unit is shown at 48 in FIG. 4.

Cherries which pass over the diverging rollers 50 without falling through the gaps 50*g* will then be conveyed by suitable ramps and/or conveyors 56, 58 to a quality inspection station 60. At this quality inspection location, cherries which are damaged or otherwise unacceptable (bird pecks, split skins, and unripe pinks etc.) are removed. This operation is typically performed manually, and the inspection station 60 includes a series of conveyors which split the flow of cherries into plural flows, each having several manual inspectors. However, it is to be understood that optical sensing and removal of undesirable cherries is also possible. After the inspection station, the cherries are then conveyed for sizing and subsequent packing.

In the arrangement of the invention shown in FIG. 4, a three stage sizing arrangement and process is depicted, however alternate arrangements are also possible as will be discussed in further detail hereinafter. In the FIG. 4 arrangement and process, the cherries initially enter a stage one sizer 70 which includes plural substantially parallel rollers R. Although three pairs of parallel rollers are shown in FIG. 4, it is to be understood that any number of adjacent roller pairs could be provided depending upon the flow requirements of the line. The cherries are fed so that they are deposited into the gap 70*g* of each roller pair. Depending upon the cherry size, as they are conveyed over the rollers R, some of the cherries will fall through the gaps 70*g*, while others will pass over the gaps 70*g* (i.e., they will not pass through the gap and will be retained on the rollers). Although the roller pairs each include parallel or nearly parallel rollers, it is to be understood that the rollers need not be perfectly parallel, and the roller pairs could be slightly diverging or slightly converging. A ratio of the inlet gap size to the outlet gap size (inlet gap÷outlet gap) of 0.9 to 1.0 for the roller pairs is presently believed acceptable in accordance with the invention. By contrast, with the prior art diverging roller arrangement, the inlet to outlet gap ratio was 0.71, and only a single pair of diverging rollers was utilized for the complete sizing operation.

After the first stage sizing, the cherries removed by the first stage are then packed as a particular size grade product, while the remaining cherries are fed to the second stage. Similarly, the second stage 80 removes additional cherries which are packed as a second size grade product, while the remaining cherries are fed to the third stage 90 which provides two additional size products as discussed in further detail below.

The gap 70*g* for each of the pairs of rollers in stage 70 are adjustable, as are the gaps 80*g*, 90*g* for the stages 80 and 90. These adjustments allow the removal efficiencies for each of the various stages to be adjusted independently so that if, for example, the cherries removed by the stage one sizer 70 include an excessive number of small cherries, the gap can be increased.

In accordance with the invention, since the gaps of each stage are adjustable independent of the gaps of the other stages, a gap adjustment of one stage will not present a problem to the removal efficiencies of the other stages. The ability to independently adjust the gaps is further advantageous in that the size which is to be retained or removed by a particular stage can also be varied. For example, as discussed earlier, if a crop is good, there will be a sufficient amount of 9 row cherries so that a "9 row or better" (i.e., cherries which have at least a 9 row size) product can be removed and packed. However, if an insufficient number of 9 row or better cherries are present so that separate packing of 9 row or better cherries is not worthwhile, the largest cherries retained can be a "9.5 row or better" product, and the gap adjustment for the removal of the largest cherries can be adjusted accordingly. The gap adjustment mechanism for the stages 70, 80, 90 are schematically represented at 72, 82, 92 in FIG. 4 and can include a threaded shaft which will vary the spacing between the rollers of that stage. The threaded shaft can be moved manually or, if desired, by a motor which is automatically controlled. In the arrangement of FIG. 4, the cherries which pass over the rollers of the first stage and which do not pass through the gaps 70*g* of the first stage will be the largest end product. These cherries are then fed by a conveyor 74 for packing and, optionally, are inspected prior to packing. The cherries which pass through the gaps 70*g* of the first stage 70 are fed, via a ramp or conveyor disposed beneath the rollers of the first stage 70, to the second stage 80.

In the preferred embodiment, the cherries which pass over the first stage without falling through the gap 70*g* will typically be either a 9 row or better product or a 9.5 row or better product, and this product is then conveyed via a conveyor 74 to a packing station 76. (As noted earlier, for certain cherry varieties, such as Lapins 8 or 8.5 row cherry might occasionally be packed. However, typically, the product retained by the first stage 70 will be either a 9 row or better or a 9.5 row or better product.) Optionally, an inspection station 78 can be provided at which a quality control check is performed. This check can be performed manually or utilizing an optical sensor/scanner 79. A manual check can be performed utilizing, for example, a sizing card as discussed earlier. If an inspection is performed, typically a representative sample size will be sufficient so that each and every cherry need not be inspected. Based upon the inspection information, the size of the gap 70*g* can be adjusted via gap adjustment 72. This adjustment can be performed manually or automatically. In particular, the gap 70*g* is set at an initial gap size believed most appropriate for the size of cherries being removed and conveyed to conveyor 74. However, if an excessive number of small cherries are being removed, or if, at the downstream inspection station 89 an excessive number of large cherries is found, the gap 70*g* can be adjusted. This adjustment can be manual, or it can be performed automatically utilizing a process controller or CPU 100 which receives sizing information and which provides a gap adjustment command as shown at 110. This gap adjustment command can be displayed so that an operator can manually adjust the gap, or the command can be used to control, e.g., or other actuator, automatically adjust the gap. As discussed in further detail hereinafter, the process controller can include a simulation program which is based upon empirical data. Thus, the user can select an initial gap setting and determine the outcome of that gap setting based upon statistical information concerning the size distribution of the cherries which are to be sorted by size.

The CPU 100 can receive signals/information from each of the inspection stations. If the inspection is performed manually, an operator will input the information using, for example, a keyboard. If the inspection utilizes an optical sensor/scanner, such as a light sensor and light beam arrangement, the information signals are sent to the CPU directly from the sensor. The information input to the CPU 100 is represented at 102, 104, 106 and 108 in FIG. 4, while the gap adjustment output commands are represented at 110, 112 and 114. Gap adjustments can be desirable to accommodate for variations in the size distributions from one group of cherries (e.g., from one grower or one site) to another group (e.g., from another grower or site). Thus, even though the removal efficiency of a particular gap size will be constant from one group of cherries to another group of cherries, since the cherry size distribution can vary from one group to another group, the resulting end products can also vary, and such variations can be accommodated by small adjustments in the gaps. Generally, such adjustments will be small and relatively infrequent since, in accordance with the present invention, the removal efficiencies of various gap sizes have been determined empirically so any adjustments will be minor and infrequent. Although automatically controlled inspection and process controls can be utilized in accordance with the present invention, it is to be understood that various aspects of the present invention can be practiced without optical scanning and process controllers.

FIG. 4 depicts a further optional modification which is possible in accordance with the present invention. In particular, as shown at 130, a representative sample of cherries (e.g., 100 or more cherries per minute) is obtained and these cherries will each be measured to provide statistical information concerning the distribution of sizes which are present in a given group of cherries. The statistical sample can be sized either manually or optically. As noted earlier, in conventional processes, representative samples are taken in order to determine the price to be paid to a grower for an incoming crop. In accordance with the present invention, size distribution obtained from the statistical samples can be utilized to determine the gap settings of the sizing rollers. The statistical information concerning the distribution of sizes for a particular group can be input to the CPU 100 as represented at 132. Once this information is input in the CPU, the CPU can then determine the initial gap settings for the various sizing stages by running a simulation which considers the removal efficiency or removal coefficient of each gap size and the flow of cherries which are presented to that gap. For example, if the statistical information reveals that a group of cherries includes 30% 9 row or better, 20% 10 row or better, 40% 11 row or better, and 10% 12 row or better. If the first stage 70 is to be utilized to remove 9 row or better cherries as a retained overs product, the CPU will then set the gap of stage 70 so that it is as large as possible without having an excessive amount of cherries which are below the 9 row grade (the precise amount of undersized cherries which are acceptable can vary depending upon agricultural regulations or depending upon the quality standards of a packer). More particularly, as discussed earlier, in accordance with one aspect of the invention, it has been recognized that, despite the fact that minimum dimension profiles for various true size cherries overlap, a given gap size will have a predictable removal efficiency or recovery rate for a given size cherry. Thus, by knowing the distribution of sizes of cherries which will be presented to a particular gap, the amount of cherries which will pass through or not pass through the gap for each size can be accurately predicted. For example, with a predetermined gap size which is known (based on empirical data) to have a 90% recovery for 9 row or better cherries, a 10% recovery efficiency for 10 row or better, and a 1% recovery efficiency for 11 row and 12 row cherries, if a thousand cherries of the previously described distribution percentages are presented to that gap, there will be 270 9 row or better (90% of the 300 9 row initially present), 20 undersized 10 row or better, 4 undersized 11 row or better, and 1 undersized 12 row or better as retained on product removed from the flow of cherries. Assuming the constraint is (either by the practice of the packer or agricultural regulations) such that the 9 row product can include no more than 10% undersized cherries, this result is acceptable, since of the 295 cherries removed by the stage 70, only 25 are undersized. Similarly, the performance of the succeeding stages 80, 90 can be determined. Here, however, in determining the gap spacing and performance of the subsequent stages, the size distribution presented to that stage is modified by subtracting the cherries which were removed by the first stage 70. Thus, in the hypothetical example of 1,000 cherries, originally including 300 9 row, 200 10 row, 400 11 row and 100 12 row, the flow presented to the second stage would include 30 9 row (300 minus the 270 removed by the first stage), 180 10 row, 396 11 row, and 99 12 row. Thus, in accordance with the present invention, particularly in view of the recognition that the performance or removal efficiency of a particular gap size will be consistent with respect to different sizes of cherries, the initial gap settings can be determined or calculated and optimally set utilizing statistical information concerning the flow of cherries to be presented to the gap setting and information as to how the removal efficiencies of a particular gap size.

Figure 8:
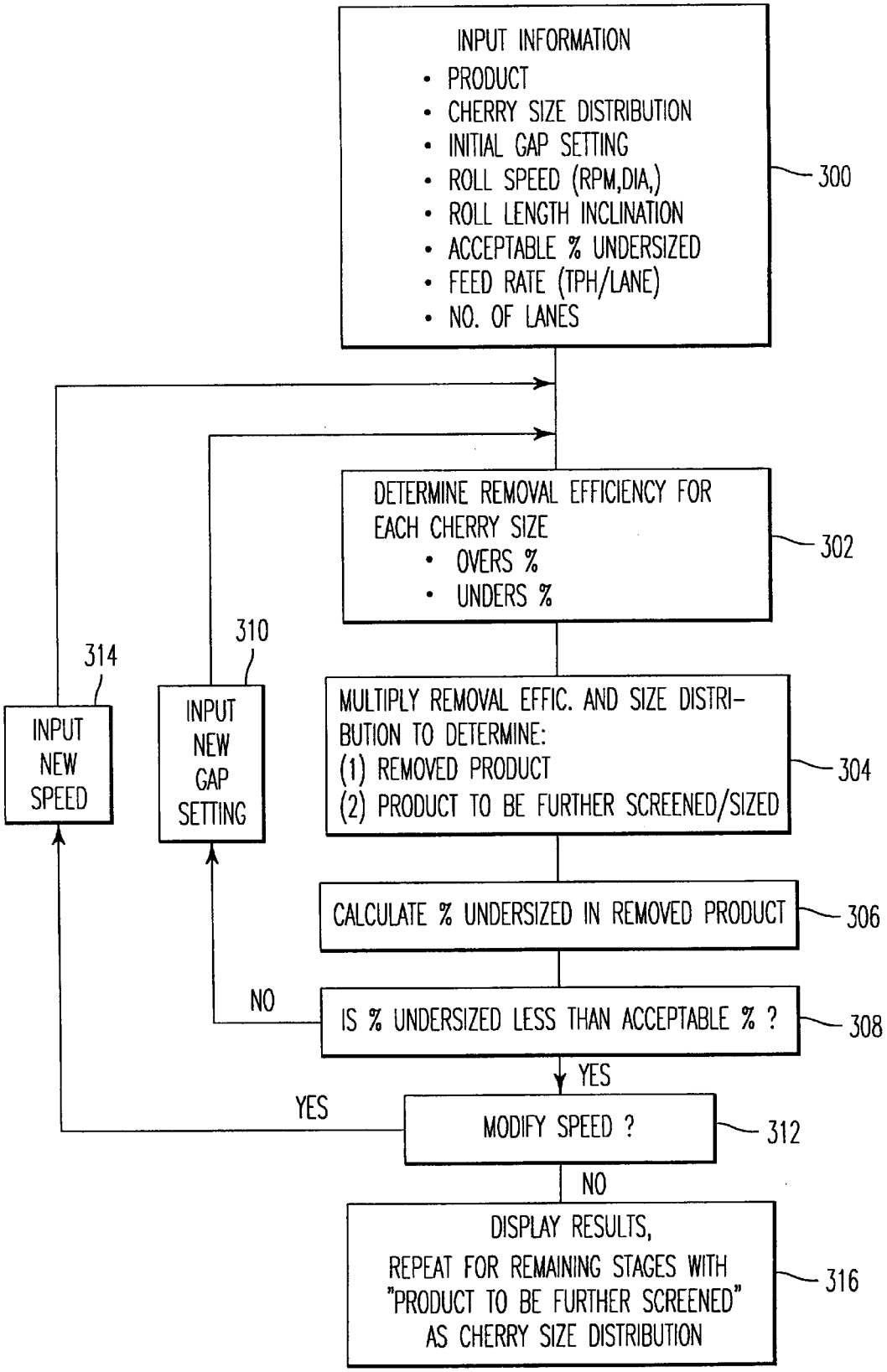
FIG. 8 is a flow diagram or algorithm for a sizing simulation.

Referring now to FIG. 8, a flow diagram of a sizing simulator routine is shown. As shown at 300, initially information is input to begin the simulation routine. Some of this information need not be input each time a simulation operation is to be run, since it will be fixed for the particular equipment being used. The input information includes the product (i.e., whether it is a 9 row or better or a 9.5 row or better, product which is to be removed by the particular stage of the sizing apparatus being simulated), the cherry size distribution (which is determined using the statistical sampling), an initial gap setting (which the user inputs or the simulator selects by initially selecting a gap within the range of recommended gaps for the particular stage and product being removed by that stage), and initial roll speed setting (which can be input as a peripheral speed, or the roll peripheral speed can be determined by inputting the rpm and roll diameter), the roller length and inclination, the acceptable percent undersized (i.e., the percent of cherries smaller than a size being packed which is tolerable or allowable), the feed rate (which can be input in tons per hour per lane, or as tons per hour and the number of lanes, i.e., the number of roller pairs present in that particular stage, with the tons per hour per lane then calculated). For a given system, the roll length, inclination, and number of lanes will typically be fixed, and therefore it is not necessary to input this information each time a simulation routine is to be run.

Although it is presently contemplated, for simplicity, that the length, number of lanes and inclination will be fixed for a given hardware configuration, it is also possible to provide hardware in which, for example, the roller slope (inclination) is adjustable or the number of lanes to be utilized is variable. In addition, although it is presently preferred to utilize a variable speed drive for the rollers, a fixed speed drive could also be utilized, such that the user need not input the roller speed upon each simulated run. Accordingly, it is to be understood that the information which is to be input to start a simulated run can vary depending upon the particular hardware which is to be utilized.

In accordance with the present invention, the feed rate should preferably be below 1.32 tons per hour (TPH) per lane. Above 1.32 TPH/lane, the cherries are not singularized as they are fed and this disrupts the ability of the equipment to properly screen/size the cherries. Also, it is preferably for the flow rate to be at least 0.5 TPH/lane. Otherwise, the sizing operation becomes excessively slow.

The acceptable percentage of undersized cherries can be input based upon agricultural regulations or based upon the internal quality control requirements of the particular packing facility. Alternately, the acceptable percent undersized need not be input, and the user of the simulator can view the percent undersized calculated by the simulator. Once the percent undersized is calculated, the percent undersized is displayed and the user, knowing the acceptable percentage, can determine whether the calculated percentage is within the acceptable limits and proceed accordingly (e.g., varying the gap setting if unacceptable, or if acceptable, optionally varying the roller speed for further optimization). The initial cherry size distribution input at 300 is obtained from a statistical sampling as discussed earlier.

Once the initial information is input, the removal efficiency for each cherry size is determined at step 302. The removal efficiency provides the percent overs product (i.e., the percent of each size which does not pass through the gap) and the percent unders or pass-through product (i.e., the percent of each size which passes through the gap) for the conditions input at 300. The removal efficiencies can be determined from look-up tables based upon empirical data, or from equations derived by modeling the empirical data. After the removal efficiencies are determined at step 302, the routine proceeds to step 304 at which the percent removal efficiency is multiplied by the actual cherry size distribution input at step 300. This multiplication determines the distribution of the overs product and the distribution of the unders product. For example, if the removed product is a 9.5 row or better product which is removed as an overs product in the first stage, the overs removal efficiency is 80%, and the initial distribution of 9.5 row or better product is 0.42 TPH, the first stage will remove 0.336 TPH (0.80×0.42) of 9.5 row or better product. Although in steps 302 and 304 both the overs removal efficiency and the unders removal efficiency can be determined, it is to be understood that only one of these percentages (and subsequent multiplication) need be determined. The other can then be determined by subtraction. Thus, in the previous example, the 9.5 row or better pass-through (unders) product can be determined as 20% of the initial distribution (0.20×0.42), or by subtracting the overs from the initial distribution (0.42–0.336). The size distribution of the product to be further screened is then used as the input cherry size distribution of the next screening stage as discussed hereinafter. Note that the removed product will typically be an overs product as shown, e.g., in FIGS. 5 and 6. However, for certain configurations, for example as shown at stages 130 and 140 of FIG. 7, the removed product will be an unders product.

Once the size distribution of the removed product is determined, the percent undersized in the removed product is calculated in step 306. This is determined by adding the total of the undersized products in the removed product size distribution and dividing that sum by the total removed product. At step 308, the percent undersized in the removed product is compared with the acceptable percent undersized. As mentioned earlier, this comparison can be done automatically by the simulator routine if the percent undersized is input. If the percent undersized exceeds the acceptable limit, the simulator either modifies the gap setting or prompts the user to input a new gap setting at step 310. Alternately, the simulator need not automatically determine whether the percent undersized is less than the acceptable limit, and the simulator can simply display the percent undersized in the removed product and the user, knowing the acceptable undersized percentage constraints, can determine whether the gap setting should be modified at step 310.

If the percent undersized is unacceptable, a new gap setting is input by the user or selected by the simulator (e.g., by increasing or decreasing the gap by a predetermined increment), and steps 302–308 are repeated. If the percent undersized is acceptable, the user can determine whether to modify the input speed. Generally, the gap setting is the predominant factor in obtaining acceptable screening. However, further optimization can be achieved by adjusting the speed once a satisfactory gap is determined. Thus, once a satisfactory gap is determined, the user can increase or decrease the speed to determine whether a better removal profile can be achieved with such a speed modification. Alternately, a user might desire to utilize a particular speed if the user believes that speed is more desirable, for example, from a standpoint of providing a manageable flow of cherries with minimal damage, or if the hardware is not equipped with variable speed drives. Thus, at step 312, the user can determine whether to modify the speed after a particular gap has been set, and if it is desired to modify the speed, a new speed can be input at step 314 and the simulation is run again. If the user does not desire to modify the speed (or if the user has already modified the speed previously so that no further modifications are desired), the routine proceeds to step 316 at which the final results are displayed. The routine is then repeated for the remaining stages of the sizing apparatus so that the gap and speed can be set for the remaining stages of the sizing apparatus. For the remaining stages, since the first stage has been determined and the product removed by that stage has been determined, the cherry size distribution for the next stage is the remainder of the cherries. In other words, the distribution of the cherries for the next stage is the cherry distribution entering the previous stage minus the cherries removed by the previous stage. Thus, the cherry size distribution input for each succeeding stage is the "product to be further screened/sized" or remaining product from the previous stages. As will be apparent, the simulator can thus predict the results in terms of the sizes removed and the cherries passing through each stage and the simulator can thus determine the most desirable gap (and optionally speed) settings for each stage. As mentioned earlier, the CPU or processor 100 which runs the simulation can also receive inspection information as a quality check after the cherries have been sized. This information can be used to modify the gaps initially selected by simulation, and thus can accommodate for variations between predicted and actual results which could occur, for example, to do variations in hardware, reliance upon a poor statistical sample, etc. If, for example, after a gap 70*g* for station 70 is selected using by the simulation routine, it is determined at inspection station 78 that excessive undersized cherries are present, the CPU can increase the gap 70*g* so that more of the undersized cherries will pass through the gap and the amount of undersized cherries removed by station 70 (to be packed at 76) is reduced.

For purposes of completeness, the remaining components of FIG. 4 will now be described. As mentioned above, the cherries received by the second stage 80 are those which passed through the gaps 70*g* of the first stage 70. These cherries are then fed into the gaps 80*g* of the roller pairs of the second stage 80 so that cherries which fall through the gaps 80*g* are fed to the third stage 90, while the cherries which pass over the rollers of the second stage 80 but which do not pass through the gaps 80*g* are retained as a second product. In a presently preferred form of the invention, these "overs" of the second stage will be either a "10 row or better" product or a "10.5 row or better" product, and this product is conveyed via conveyor 84 to a packing station 86. As with the first stage, an inspection station 88 can optionally be provided, and the inspection can be performed manually or via an automatic sensor, such as a light beam and light sensor depicted at 89. The cherries which pass through the gaps 80*g* are then fed to the third stage 90. In a presently preferred embodiment of the invention, the third stage 90 is the final stage. As a result, two products will result from this stage, including a stage three "overs" product (i.e., cherries which are conveyed over the rollers of the third stage 90 but which do not pass through the gaps 90*g*) which are conveyed via conveyor 94 to a packing station 96, and a stage three through product which includes the smaller cherries which pass through the gaps 90*g* and are fed via a ramp or conveyor to a conveyor 93 to feed the cherries to a further packing station 101. As with the other stages, inspection stations 95, 98 can be provided, and the inspection can either be manual or automatic.

With the arrangement shown in FIG. 4, the gap sizes progressively decrease from stage one to stage three. In particular, the first gap 70*g* will be larger than the second gap 80*g*, and the second gap 80*g* will be larger than the third gap 90*g*. With this arrangement, the largest cherries are removed first and are removed as an "overs" product. The second largest cherries are removed second and are also removed as "overs" product. Finally, the third stage separates the remaining cherries into two of the smaller size grades, with the larger of these being an overs product and the smaller being the through product of the third stage.

Figure 5:
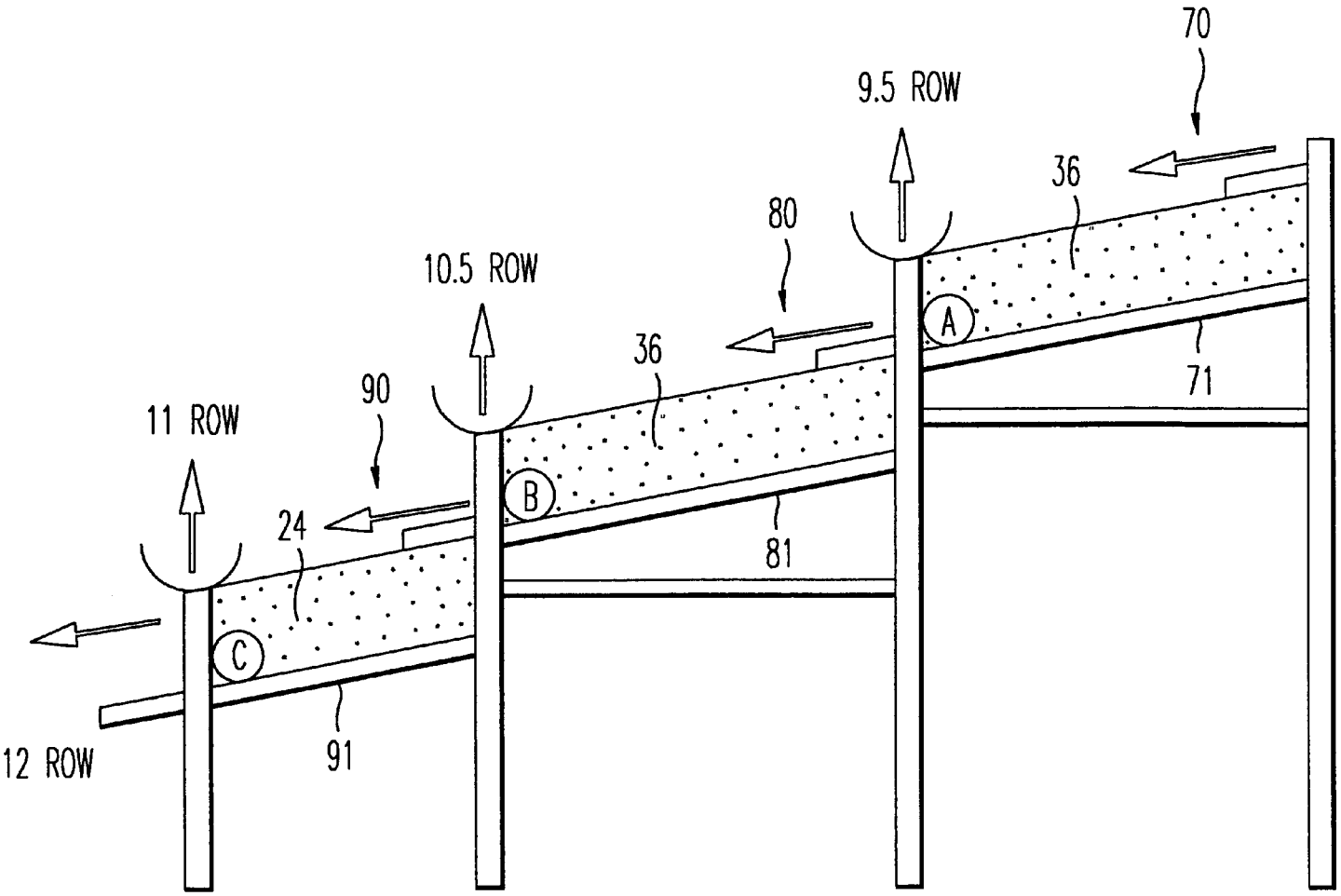
FIG. 5 depicts a first embodiment of the sizing apparatus and process of the invention.

FIG. 5 provides a further illustration of the arrangement shown in FIG. 4. In particular, as shown in FIG. 5, the gap of the first stage is sized so that the largest cherries will pass over the first stage without passing through the gap 70*g* of each roller pair. As shown in FIG. 5, the largest cherries are a 9.5 row or better product. However, as discussed earlier, if large cherries of sufficient quantities exist, the initial product can be a 9 row or better product. It has been determined empirically that where the retained overs product for the first stage 70 is either an 8 row or better or an 8.5 row or better product, the gap should be in the range of 30.0–25.0 mm where the first stage retained overs product is a 9 row or better or a 9.5 row or better, the gap 70*g* should be 25.0–22.0 mm.

The cherries which pass through the gap 70*g* of the first stage are then conveyed via a conveyor or ramp 71 to the second stage. In the FIG. 5 arrangement, the gap 80*g* of the second stage is smaller than the gap 70*g* of the first stage. Cherries which pass over the rollers of the second stage but which do not pass through the gap 80*g* are then removed as the second largest product. As shown in FIG. 5, this is a 10.5 row or better product. As discussed earlier, this product could also be a 10 row or better product. If the retained product is a 10 row or better or a 10.5 row or better product, the gap 80*g* should be 23.0–20.0 mm.

Cherries which pass through the gap 80*g* of the second stage are fed via a ramp or conveyor 81 to the third stage 90. The gap 90*g* of the third stage would be smaller than that of the second stage. Since, in the FIG. 5 embodiment, the third stage is the final stage, two end products will result, the larger of which will be the "overs" product which does not pass through the gap 90*g*, the other of which will be the pass through product which includes the cherries which pass through the gap 90*g* and which are conveyed via a conveyor or ramp 91 to the conveyor 93 discussed earlier. In the arrangement shown in FIG. 5, the stage three overs product is an 11 row or better product while the pass through product is 12 row or better product. Where the retained overs product for the third stage is an 11 row or better or an 11.5 row or better product, the gap of the third stage should be in the range of 21.0–18.0 mm.

FIG. 5 also demonstrates an additional advantage which is made possible by the arrangement of the present invention. In particular, as shown in FIG. 5, the first stage and second stage are longer than the third stage. In accordance with the present invention, it has been recognized that longer rollers are beneficial in removing larger cherries, while there is little benefit from such longer rollers in the downstream stages or the stages utilized for smaller cherries. Thus, the first two stages can include 36" length rollers, while the third stage can include 24" rollers. By using different roller sizes a cost savings (using shorter rollers for the sorting of the smaller cherries) can be recognized if a large number of systems are manufactured. However, in manufacturing a small number of systems it has been found that it is more economical to utilize common parts for each of the stages, and thus, rollers of equal lengths among the stages are preferred.

In accordance with the invention, the various parameters which could be varied or examined in terms of their performance in removing cherries of each given size from a flow of cherries having various sizes. The parameters considered were tons per hour (TPA) per lane, gap size, inclination of the rollers, the rotational speed (or peripheral speed) of the rollers and the length of the rollers. Generally, the removal efficiencies were found to be dependent on inclination of rollers, rotation (peripheral) speed, length and gap. The inclination and rotational speed should be sufficient to provide a satisfactory flow of cherries and so that the cherries are singularly fed along the gaps of the rollers. However, it has also been determined that if the inclination is greater than 17° or the rotational speed is such that All the surface speed of the rollers is greater than 261 feet per minute, damage to the cherries can result. Thus, the rollers should be inclined at an angle from horizontal of 17° or less, and preferably in the range of 12–15°. In addition, the surface speed of the rollers should be at least 104 fpm. For a 2 inch diameter roller, this will be equivalent to 200 rpm. The peripheral speed should therefore be between 104 fpm and 261 fpm. The particular rotational speed in revolutions per minute will depend upon the diameter of the rollers.

With regard to the length of the rollers, as noted above, it was recognized that a longer length can be desirable for larger cherries, however for consistency/modularity of the components, the roller lengths for different stages can be the same. It was also determined that where the roller length is less than 18 inches for a given size the performance deteriorated to an unacceptable level. Thus, the roller length for each stage should be at least 24 inches for 11, 11.5 and 12 row zones, and preferably 36 inches or larger 9, 9½, 10 and 10½ row zones. By contrast, as discussed earlier herein, with the prior art diverging roller arrangement, an 84– roller was utilized so that each size utilized approximately 17–18 inches of that roller. The present invention does not utilize single rollers which are of the length utilized in the prior art and rollers in excess of 50" were found to provide no benefit as compared with rollers of shorter lengths where separate rollers are utilized in each stage of a multiple stage sizing arrangement. Thus, in accordance with the invention, it is presently preferred to utilize rollers which are greater than 18" and less than 50" in length.

The cherries are conveyed to the first sizing stage 70 utilizing a conveyor and the conveyor feeds the cherries at a rate of, e.g., 40 feet per minute. In a presently preferred form, the ramp or pan disposed beneath the rollers of each of the stages is fed with water to assist in feeding of the cherries. Preferably, the water is fed so that the cherries attain a speed of up to 250 feet per minute, but at least 40 feet per minute. Since the pan of the first stage feeds into the second stage, and the pan of the second stage 80 feeds into the third stage 90, only a small amount of makeup water is provided in the stages after the first stage, and the primary water feed is provided at the first stage 70.

Figure 6:
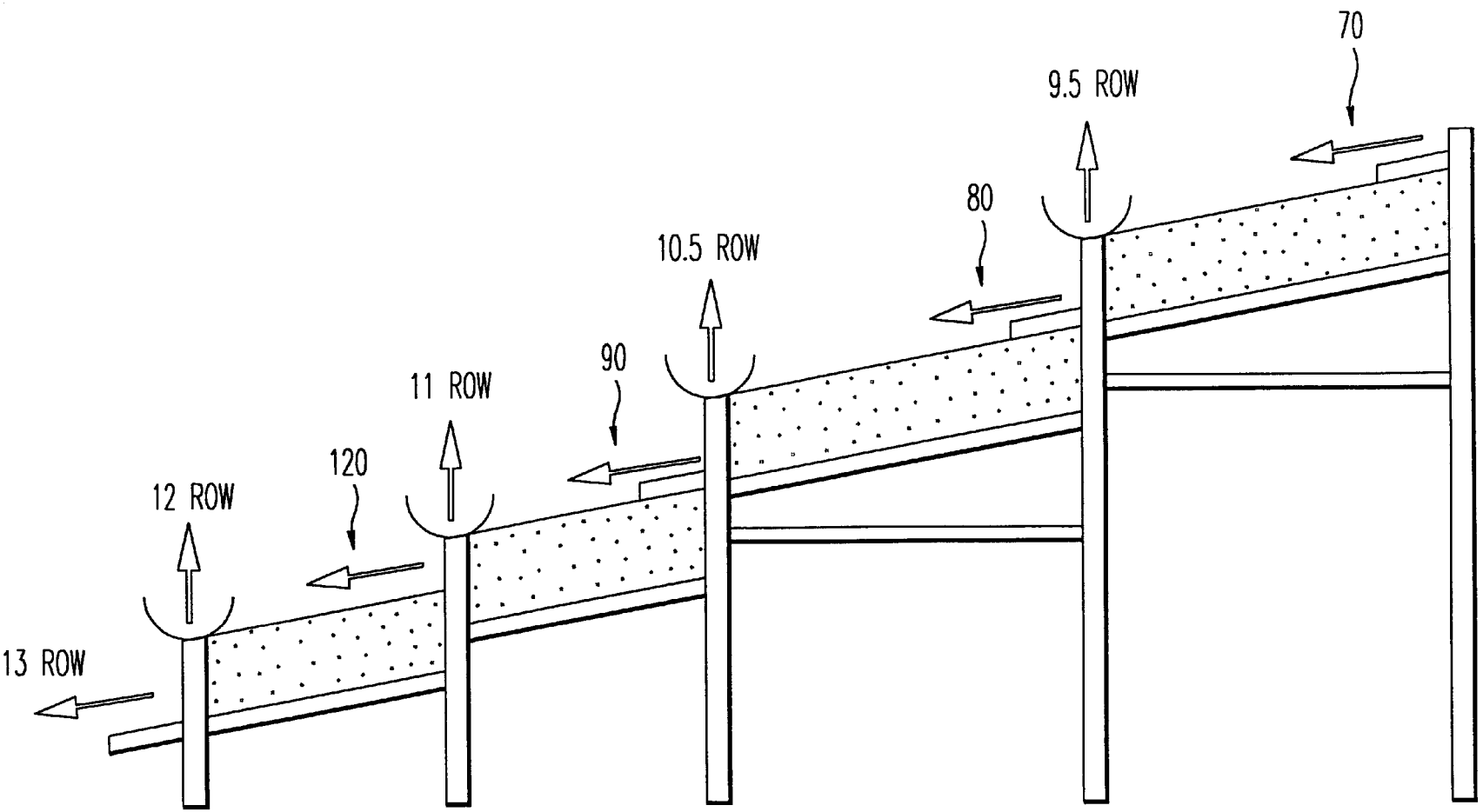
FIG. 6 depicts a second embodiment of the sizing apparatus and process of the invention.

FIG. 6 depicts the arrangement of FIG. 5 in which an optional fourth stage 120 is provided. This additional fourth stage 120 can be utilized where excessive amounts of smaller cherries are found to be present in the pass through product of the third stage 90. With this arrangement, the fourth stage 120 will have a gap which is smaller than the gap of the third stage 90*g* so that the retained "overs" product of the fourth stage 120 will be a 12 row or better product, while the pass through product of the fourth stage will be a 13 row product. The gap for the fourth stage 120 should be in the range of 18.0–16.0 mm. However, typically the 13 row cherries have been removed by the diverging roller pre-eliminator discussed earlier, so that a fourth stage will usually not be necessary.

Figure 7:
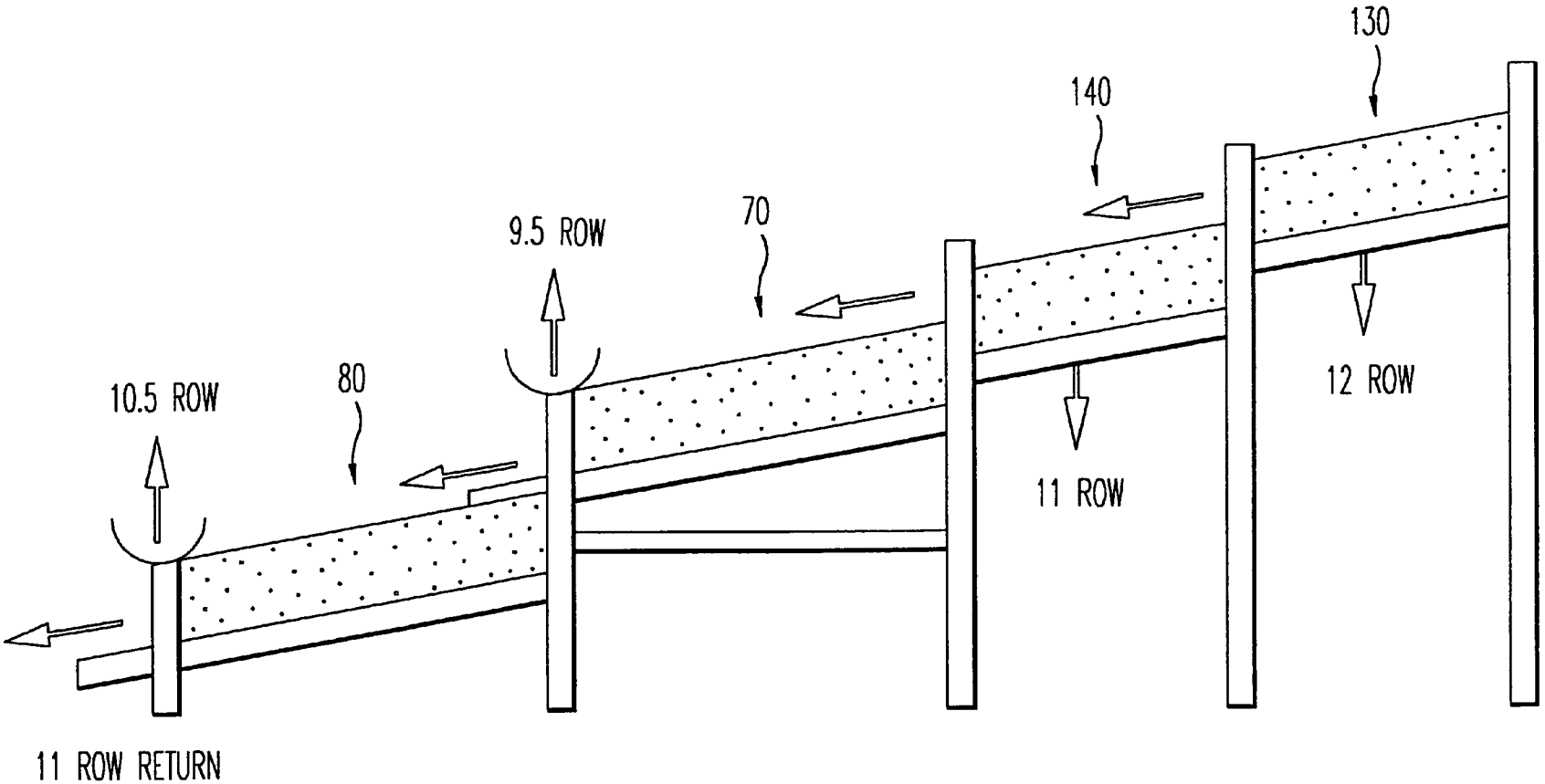
FIG. 7 depicts a third embodiment of the apparatus and process of the invention.

FIG. 7 depicts an alternate embodiment of the invention. In the FIG. 7 embodiment, the smaller cherries are initially removed, followed by removal of the largest cherries and then removal of the second largest cherries. However, like the earlier embodiments, each stage includes rollers having a gap which is independently adjustable, i.e., independent of the other stages. In addition, as in the earlier embodiments, the rollers are preferably parallel so that a substantially constant gap is presented for each stage. As also discussed earlier, the gap of a given stage can vary slightly from parallel and the ratio of the inlet gap size to the outlet gap size can be in the range of 0.9 to 1.1. Like the earlier embodiments, in the FIG. 7 arrangement the largest cherries are removed before the end of the sizing operation, thereby reducing the likelihood that the larger cherries will be lost into the smaller sizing grades. Although the smallest cherries are removed first, since these stages will have relatively small gaps, there is less likelihood that the largest cherries will be lost to the smaller size grades as compared with the conventional diverging roller sizing arrangement.

In the FIG. 7 arrangement, the stages can be described with reference to their gap size for consistency with the earlier embodiments. Thus, the stage 70 having the largest gap spacing can be considered as the first stage—removing the largest product, although it is actually third in terms of its sequence in the sizing operation of the FIG. 7 embodiment. The second stage 80, i.e., second in terms of gap size, is actually the fourth in terms of its sequence in the sizing operation.

The cherries initially enter the sizing operation and are presented with the rollers having the smallest gap therebetween at stage 130, which is the fourth stage in terms of the gap size. Cherries which pass through the gap of the fourth stage 130 will be, for example, a 12 row product. Thus, in contrast to the earlier embodiments, the initial product removed at stage 130 is a pass through product. Cherries which pass over the stage 130 are fed to the stage 140 which includes rollers having a gap spacing which is larger than that of stage 130. As with stage 130, the product removed by stage 140 will be a pass through product, i.e., products which will pass through the gaps in the rollers of this stage. This pass through product will be the third largest product in terms of size and can be, for example, an 11 row product. The cherries which pass over the stage 140 are then fed to the stage earlier referred to as the first stage 70 and, as with the earlier embodiments, this stage will remove the largest cherries as an overs product. In particular, as discussed earlier, cherries which pass over the stage 70 and which do not pass through the gap 70*g* will be retained as the largest product (either a 9 row or better or a 9.5 row or better product). In accordance with the present invention, it has been recognized that the removal efficiency of a particular gap size is constant. Therefore, the gap size 70*g* in the FIG. 7 embodiment will be the same as that of the earlier embodiments. Also, as with the earlier embodiments, the pass through product is fed to the second stage 80 (i.e., the stage which is second largest in terms of its gap size) and the stage 80 will retain the second largest product (preferably either a 10 row or better product or a 10.5 row or better product) as an overs product. The pass through product can be combined with the 11 row product removed as a pass through product at stage 140. The gap for stage 140 should be in the range of 22.0–19.0 mm where the pass through product is an 11 row or an 11.5 row product. The gap for the stage 130 should be 19.0–16.0 mm. Thus, the FIG. 7 arrangement can provide four different products, including a first largest product which includes the overs of stage 70, a second largest product which includes the overs of stage 80, a third largest product which includes the pass through of stages 80 and 140, and a fourth largest product which includes the pass through product of stage 130.

As should be readily apparent from the foregoing, the present invention is advantageous in numerous respects as compared with the prior art diverging roller arrangement. In particular, with the present invention, the cherries are removed utilizing stages having gap settings which can be adjusted independent of the other stages. Further, by avoiding the diverging roller arrangement for sizing all cherries, each gap setting can be precisely tuned to the most effective for removal of a particular cherry size, based upon one of the recognitions of the invention that a particular gap size will have a constant efficiency for removing cherries of a particular true size. In contrast, the prior art diverging roller arrangement relied upon a diverging gap arrangement so that adjustments of the gap adjusted the gap for each sizing location. Further, with the conventional diverging roller arrangement the cherries were actually sized based upon their minimum dimension, making the sizing operation even more difficult since cherries of a given minimum dimension can have a number of different true sizes, i.e., maximum dimensions.

Although different preferred embodiments of the invention are disclosed herein, it is to be understood that alternate embodiments are also possible in accordance with the teachings herein.

Obviously, numerous modifications and variations of the present invention are possible in light of the above teachings. It is therefore to be understood that within the scope of the appended claims, the invention may be practiced otherwise than as specifically described herein.

What is claimed is:

1. A method for sizing cherries comprising:

passing a first flow of cherries over a first pair of rotating rollers, said first pair of rotating rollers having a first gap therebetween, said first gap including a first inlet gap spacing at an upstream end of said first pair of rotating rollers and a first outlet gap spacing at a downstream end of said first pair of rotating rollers, and wherein a ratio of said first inlet gap spacing to said first outlet gap spacing is in the range of 0.9 to 1.1, the method including sizing said first gap such that cherries which pass through said first gap are predominantly smaller than one of: (a) 9 row cherries and (b) 9.5 row cherries;

passing a second flow of cherries over a second pair of rotating rollers, said second pair of rotating rollers having a second gap therebetween, said second gap including a second inlet gap at an upstream end of said second pair of rotating rollers and a second outlet gap at a downstream end of said second pair of rotating rollers, wherein a ratio of said second inlet gap spacing to said second outlet gap spacing is in the range of 0.9 to 1.1, and wherein the method further includes sizing said second gap such that cherries which pass through said second gap are predominantly smaller than one of: (a) 10 row cherries and (b) 10.5 row cherries.

2. A method of sizing cherries as recited in claim 1, further including:

mounting said first pair of rotating rollers such that said first pair of rotating rollers is inclined from horizontal at an angle in the range of 12° to 15°; and mounting said second pair of rotating rollers such that said second pair of rotating rollers is inclined from horizontal at an angle in the range of 12° to 15°.

3. A method of sizing cherries as recited in claim 2, further including rotating said first pair of rotating rollers at a peripheral speed in the range of 104 feet per minute to 261 feet per minute, and rotating said second pair of rotating rollers at a peripheral speed in the range of 104 feet per minute to 261 feet per minute.

4. A method of sizing cherries as recited in claim 1, wherein said first gap is in the range of 22.0 mm to 30.0 mm.

5. A method of sizing cherries as recited in claim 4, wherein a size of said second gap is in the range of 20.0 mm to 23.0 mm.

6. A method as recited in claim 1, further including disposing said second pair of rotating rollers downstream of said first pair of rotating rollers and feeding cherries which pass through said first gap to said second pair of rotating rollers such that said second flow of cherries includes cherries which passed through said first gap.

7. A method as recited in claim 6, further including retaining cherries which pass over said first pair of rotating rollers and which do not pass through said first gap as a first product, said first product being one of (a) a 9 row or better product and (b) a 9.5 row or better product.

8. A method as recited in claim 7, further including retaining cherries which pass over said second pair of rollers and which do not pass through said second gap as a second product, said second product being one of (a) a 10 row or better product and (b) a 10.5 row or better product.

9. A method as recited in claim 8, further including providing a third pair of rotating rollers having a third gap therebetween, wherein said third gap is smaller than said first gap and said third gap is smaller than said second gap.

10. A method as recited in claim 9, wherein said third pair of rotating rollers is disposed downstream of said second pair of rotating rollers, the method further including feeding cherries which pass through said second gap to said third pair of rotating rollers.

11. A method as recited in claim 10, further including retaining cherries which pass over said third pair of rotating rollers and which do not pass through said third gap as a third product.

12. A method as recited in claim 11, further including retaining cherries which pass through said third gap as a fourth product.

13. A method as recited in claim 11, wherein said third gap has a size in the range of 18.0–21.0 mm.

14. A method as recited in claim 9, wherein said third pair of rotating rollers is disposed upstream of said first pair of rotating rollers, the method further including feeding cherries which pass over said third pair of rotating rollers and which do not pass through said third gap to said first pair of rotating rollers.

15. A method as recited in claim 14, further including retaining cherries which pass through said third gap and cherries which pass through said second gap as a third product.

16. A method as recited in claim 15, further including providing a fourth pair of rotating rollers having a fourth gap therebetween, with said fourth pair of rotating rollers disposed upstream of said third pair of rotating rollers, and wherein said fourth gap is smaller than said third gap, the method further including retaining cherries which pass through said fourth gap as a fourth product and feeding cherries which pass over said fourth pair of rotating rollers and which do not pass through said fourth gap to said third pair of rotating rollers.

17. A method as recited in claim 16, wherein a size of said third gap is in the range of 19.0 mm to 22.0 mm.

18. A method as recited in claim 9, further including providing a pair of pre-eliminator rollers upstream of said first, second and third pairs of rotating rollers, said pair of pre-eliminator rollers having a diverging gap such that a size of the diverging gap at an upstream end of said pair of pre-eliminator rollers is smaller than a size of said diverging gap at a downstream end of said pair of pre-eliminator rollers, the method further including collecting at least first and second groups of cherries which pass through said diverging gap, wherein said first group comprises cherries which fall through said diverging gap closer to the upstream end of said pair of pre-eliminator rollers as compared with said second group.

19. A method for sizing cherries comprising:

providing an assembly of rotating rollers comprising:

(a) first pair of rotating rollers having a first gap therebetween;

(b) second pair of rotating rollers having a second gap therebetween; and (c) third pair of rotating roller having a third gap therebetween;

wherein said first gap is larger than said second gap and said second gap is larger than said third gap, the method further including disposing each of said first, second and third pairs of rotating rollers at an incline from horizontal which is in the range of 12°–15°;

wherein the method further includes feeding a flow of cherries to said assembly of rotating rollers.

20. A method as recited in claim 19, further including:

feeding a first flow of cherries to said first pair of rotating rollers and retaining cherries which pass over said first pair of rotating rollers and which do not pass through said first gap as a first product; and disposing said second pair of rotating rollers downstream from said first pair of rotating rollers, feeding a second flow of cherries to said second pair of rotating rollers and retaining cherries which pass over said second pair of rollers and which do not pass through said second gap as a second retained product, and wherein said second flow of cherries comprises cherries which passed through said first gap.

21. A method as recited in claim 20, further including disposing said third pair of rotating rollers downstream from said second pair of rotating rollers and feeding a third flow of cherries to said third pair of rotating rollers, wherein said third flow of cherries comprises cherries which passed through said second gap;

the method further comprising retaining cherries which pass over said third pair of rotating rollers and which do not pass through said third gap as a third product.

22. A method as recited in claim 20, further including disposing said third pair of rotating rollers upstream of said first pair of rotating rollers, and feeding cherries which pass over said third pair of rotating rollers and which do not pass through said third gap to said first pair of rotating rollers such that said first flow of cherries comprises cherries which passed over said third pair of rotating rollers, the method further including retaining cherries which pass through said second gap and cherries which pass through said third gap as a third product.

23. A method as recited in claim 19, wherein a size of said first gap at an upstream end of said first pair of rotating rollers divided by a size of said first gap at a downstream end of said rotating rollers is in the range of 0.9 to 1.1; and a size of said second gap at an upstream end of said rotating rollers divided by a size of said gap at a downstream end of said rotating rollers is in the range of 0.9 to 1.1.

24. A method as recited in claim 19, further including providing a pair of pre-eliminator rollers upstream of said first, second and third pairs of rotating rollers, said pair of pre-eliminator rollers having a diverging gap such that a size of said gap at an upstream end of said pair of pre-eliminator rollers is smaller than a size of said diverging gap at said downstream end of said pre-eliminator rollers.

25. A method as recited in claim 19, wherein said first gap has a size in the range of 22.0–25.0 mm.

26. A method as recited in claim 19, further including retaining cherries which pass over said first pair of rotating rollers and which do not pass through said first gap as a first product, wherein said first product comprises one of: (a) a 9 row or better product, and (b) a 9.5 row or better product.

27. A method as recited in claim 19, wherein said second gap has a size in the range of 20.0–23.0 mm.

28. A method as recited in claim 19, wherein cherries which pass over said second pair of rotating rollers and which do not pass through said second gap are retained as a second product, wherein said second product comprises one of: (a) 10 row or better product, and (b) 10.5 row or better product.

29. A method as recited in claim 19, wherein said first gap has a size in the range of 22.0–25.0 mm, and the second gap has a size in the range of 20.0–23.0 mm.

30. A method as recited in claim 29, wherein said third gap has a size in the range of 18.0–21.0 mm.

31. A method as recited in claim 30, wherein said first pair of rotating rollers rotates at a peripheral speed in the range of 104 feet per minute to 261 feet per minute, and said second pair of rotating rollers rotates at a peripheral speed in the range of 104 feet per minute to 261 feet per minute.

* * * * *

UNITED STATES PATENT AND TRADEMARK OFFICE

CERTIFICATE OF CORRECTION

PATENT NO. : 6,260,713 B1
DATED : July 17, 2001
INVENTOR(S) : Robert A. Brown

It is certified that error appears in the above-identified patent and that said Letters Patent is hereby corrected as shown below:

Column 3,
Line 51, change "lager" to -- larger --.

Column 17,
Line 12, delete "All";
Line 32, change "84-" to -- 84" --.

Column 21,
Line 16, before "first" (first occurrence) insert -- a --;
Line 18, before "second" (first occurrence) insert -- a --;
Line 20, before "third" (first occurrence) insert -- a --; change "roller" to -- rollers --.

Signed and Sealed this

Thirtieth Day of April, 2002

*Attest:*

*Attesting Officer*

JAMES E. ROGAN
*Director of the United States Patent and Trademark Office*